US006250383B1

(12) United States Patent
Patel

(10) Patent No.: US 6,250,383 B1
(45) Date of Patent: Jun. 26, 2001

(54) LUBRICATOR FOR UNDERBALANCED DRILLING

(75) Inventor: Dinesh R. Patel, Sugar Land, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 0 days.

(21) Appl. No.: 09/531,945

(22) Filed: Mar. 21, 2000

Related U.S. Application Data

(60) Provisional application No. 60/143,322, filed on Jul. 12, 1999.

(51) Int. Cl.[7] ..... E21B 23/08; E21B 34/10

(52) U.S. Cl. ..... 166/70; 166/319; 166/323; 166/332.3; 137/630; 175/318

(58) Field of Search ..... 166/70, 319, 321, 166/323, 332.3; 175/317, 318, 324; 137/629, 630

(56) References Cited

U.S. PATENT DOCUMENTS

| | | | | |
|---|---|---|---|---|
| 2,921,601 | | 1/1960 | Fisher, Jr. . | |
| 3,078,923 | | 2/1963 | Tausch . | |
| 3,667,557 | | 6/1972 | Todd et al. . | |
| 3,696,868 | | 10/1972 | Taylor, Jr. . | |
| 3,741,249 | | 6/1973 | Leutwyler . | |
| 3,967,647 | | 7/1976 | Young . | |
| 4,062,406 | | 12/1977 | Akkerman et al. . | |
| 4,074,761 | | 2/1978 | Mott . | |
| 4,103,744 | | 8/1978 | Akkerman . | |
| 4,368,871 | | 1/1983 | Young . | |
| 4,476,933 | | 10/1984 | Brooks . | |
| 4,846,281 | | 7/1989 | Clary et al. . | |
| 4,903,775 | * | 2/1990 | Manke | 166/319 X |
| 5,518,073 | * | 5/1996 | Manke et al. | 166/321 X |
| 5,810,087 | * | 9/1998 | Patel | 166/323 X |
| 5,857,523 | * | 1/1999 | Edwards | 166/379 X |
| 6,085,845 | * | 7/2000 | Patel et al. | 166/373 |
| 6,167,974 | * | 1/2001 | Webb | 175/318 X |

* cited by examiner

*Primary Examiner*—George Suchfield
(74) *Attorney, Agent, or Firm*—Trop, Pruner & Hu P.C.

(57) ABSTRACT

A system usable with a subterranean well includes a tubing and a lubricator. The tubing is adapted to receive a drill string in a passageway of the tubing, and the lubricator is located downhole and is connected to the tubing. The lubricator is adapted to be remotely operable from a surface of the well to control fluid communication between the passageway located above the lubricator and a formation located beneath the lubricator. The lubricator may include a sleeve and controller. The controller selectively moves the sleeve into a passageway of a valve of the lubricator to protect the valve from a downhole fluid.

28 Claims, 12 Drawing Sheets

LUBRICATOR FOR UNDERBALANCED DRILLING

This application claims the benefit, under 35 U.S.C. §119, to U.S. Provisional Patent Application Ser. No. 60/143,322, entitled, "LUBRICATOR FOR UNDERBALANCED DRILLING," filed on Jul. 12, 1999.

BACKGROUND

The invention relates to a lubricator for underbalanced drilling.

There are two techniques that typically are used to drill a borehole in a formation: an overbalanced drilling technique and underbalanced drilling technique. In overbalanced drilling, fluid in an annulus of a well is used to exert a pressure that is greater than the formation pressure. Thus, the pressure that is exerted by the annulus fluid keeps formation fluids from exiting the well. A drawback to this technique is that mud particles typically are added to the annulus fluid to increase its weight (and thus, increase its downhole pressure), and these mud particles tend to clog up openings in the formation. Thus, the formation may be damaged by overbalanced drilling, and after drilling, cleanup of the well may be needed before production begins. The well may also need to be tested after overbalanced drilling to check for formation damage.

Unlike overbalanced drilling, underbalanced drilling typically does not damage the formation damage and typically maximizes reservoir inflow. In underbalanced drilling, heavy annulus fluid is not used to suppress the formation pressure. Instead, a blowout preventer, or snubbing unit, is used to seal off the drill string at the surface of the well. However, this arrangement may also present difficulties. For example, when drilling at shallow depths or retrieving the drill string, the upward force from the formation pressure may exceed the weight of the drill string and thus, may force the drill string out of the borehole. As a result, retrieving the drill string may consume a considerable amount of time and present a significant danger.

Thus, there is a continuing need for an arrangement to address one or more of the problems that are stated above.

SUMMARY

In an embodiment of the invention, a system usable with a subterranean well includes a tubing and a lubricator. The tubing is adapted to receive a drill string in a passageway of the tubing, and the lubricator is located downhole and is connected to the tubing. The lubricator is adapted to be remotely operable from a surface of the well to control fluid communication between the passageway located above the lubricator and a formation located beneath the lubricator.

In another embodiment of the invention, an apparatus that is usable with a downhole tool that has a passageway includes a sleeve and a controller. The controller selectively moves the sleeve into the passageway to protect a portion of the downhole tool from a downhole fluid.

Advantages and other features of the invention will become apparent from the following description, drawing and claims.

DETAILED DESCRIPTION

Figure 1:
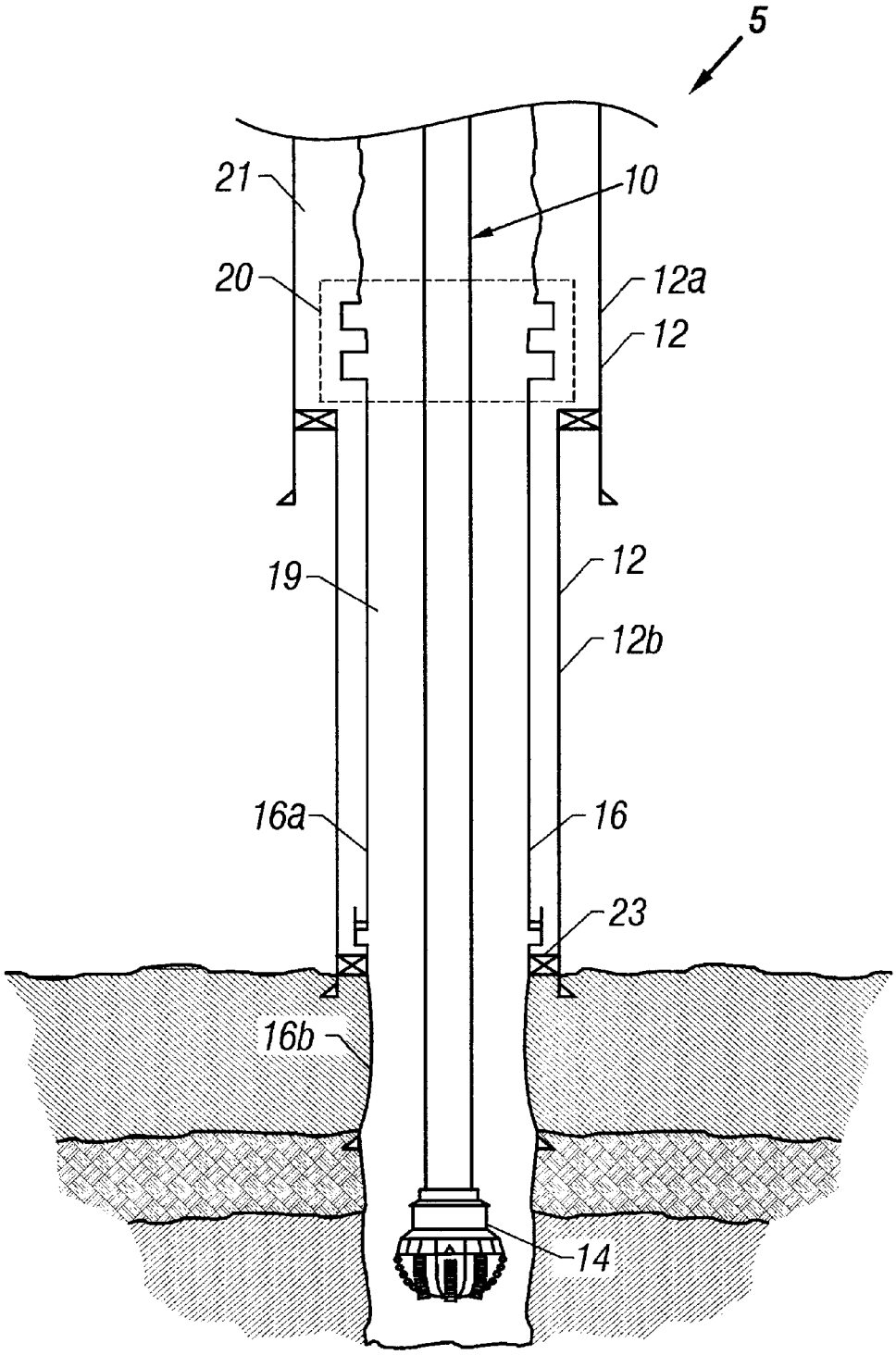
FIG. 1 is a schematic diagram of a subterranean well according to an embodiment of the invention.

Referring to FIG. 1, in a subterranean well 5, an embodiment 20 of a downhole lubricator in accordance with the invention may be used for underbalanced drilling. When a drill pipe, or string 10, is inserted through a central passageway of the lubricator 20, the lubricator 20 forms a seal between an annulus 19 that is formed from the exterior surface of the string 10 and the interior surface of a concentric tubing 16. When the drill string 10 is withdrawn from the lubricator 20, the lubricator 20 may be remotely operated from the surface of the well 5 to selectively seal off its central passageway. In this manner, the lubricator 20 may either be open to allow the drill string 10 to be inserted downhole through the central passageway of the lubricator 20 (as depicted in FIG. 1) or closed to seal off the formation(s) below the lubricator 20 from the portion of the well 5 that is located above the lubricator 20.

Because the design of the lubricator 20 permits the lubricator 20 to be positioned a sufficient distance (approximately one to three thousand feet, for example) downhole, the lubricator 20 may be advantageous for shallow drilling or for retrieval of the drill string 10 from the borehole. For example, during retrieval of the drill string 10, the lubricator 20 may be used to seal off the formation that is beneath the drill string 10 before the drill string 10 is otherwise shallow enough to cause the formation pressure to overcome the weight of the drill string 10 and thus, force the drill string 10 out of the borehole. As described further below, depending on the particular embodiment, the lubricator 20 may be selectively opened or closed by manipulating the pressure of fluid in an annulus of the well or by varying a pressure on a pressure control line. Safety features that accompany these controls are also described below. As examples of these features, the lubricator may include redundant inline ball valves (described below) to minimize the risk of potential seal failure and a hold close mechanism to prevent accidental opening of the lubricator.

As depicted in FIG. 1, the borehole of the subterranean well 5 may be partially cased by a casing 12 that is formed from telescopic sections, such as sections 12*a* and 12*b*, as examples. The tubing 16 may also be formed from telescopic sections, such as sections 16*a* and 16*b*, as examples, and be inserted into the central passageway of the casing 12. An annular seal, or packer 23, may form a seal between the exterior of the drill pipe 10 and the interior of the tubing 16 and form an annulus 21. A drill bit 14 of the drill string 10 may extend beyond the tubing 16 into the formation being currently drilled.

Figure 2:
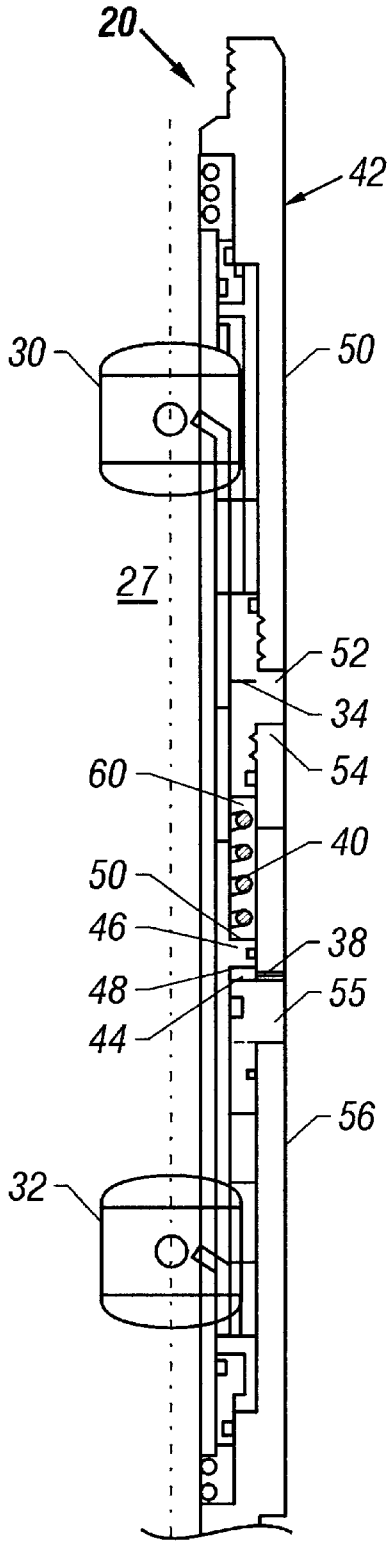
FIG. 2 is a cross-sectional view of a lubricator according to an embodiment of the invention.

FIG. 2 generally depicts one-half of the lubricator 20. As shown, the lubricator 20 may include an operator mandrel 34 that may be actuated by annulus fluid pressure to operate an upper inline ball valve 30 and a lower inline ball valve 32, both of which are situated in a central passageway 27 of the lubricator 20. In some embodiments, the ball valves 30 and 32 may be closed when no pressure is applied to the fluid in the annulus 21 (see FIG. 1). In this manner, the fluid in the annulus 21 may (via a radial port 38) contact a lower surface 48 of a piston head 46 of the operator mandrel 34, and an upper surface 50 of the piston head 46 may contact a spring 40. When no surface pressure is applied to the fluid in the annulus 21, the downward force of the spring 40 on the piston head 46 counters the upper force that is produced by the column of fluid in the annulus 21.

However, when additional pressure is applied to the column of fluid at the surface of the well 5, an additional upward force is applied to the piston head 46 to cause the operator mandrel 34 to move in an upward direction and compress the spring 40. The upward travel of the operator mandrel 34, in turn, rotates the ball valves 30 and 32 to their open positions. When the applied surface pressure is released, the spring 40 forces the operator mandrel 34 back down to close the ball valves 30 and 32. It is noted that the upper end of the operator mandrel 34 is coupled to a position of the ball valve 30 that is different than a position to which a lower end of the operator mandrel 34 is coupled. These connection differences cause both ball valves 30 and 32 to open in response to the upward travel of the operator mandrel 34 and to close in response to the downward travel of the operator mandrel 34.

Alternatively, in other embodiments, the operator mandrel 34 may be connected to the ball valves 30 and 32 in a manner that causes the ball valves 30 and 32 to both be open when no surface pressure is applied to the fluid in the annulus 21 and cause both ball valves 30 and 32 to be closed when surface pressure is applied to the annulus 21. An alternative embodiment 70 described in conjunction with FIGS. 3 and 4 below includes a hold close mechanism to prevent unintentional opening of the ball valves 30 and 32 due to a temporary release, or bleeding off, of annulus pressure (due to a failure at the surface of the well, for example).

Among the other features of the lubricator 20, in some embodiments, the lubricator 20 may include an outer housing 42 that includes a generally cylindrical upper section 50 that has threads for connecting the lubricator 20 inline with the tubing 16. A mandrel 52 of the housing 42 is threadably coupled to the bottom of the upper section 50 between the upper section 50 and a generally cylindrical middle section 54 of the housing 42. The mandrel 52, in combination with the exterior of the operator mandrel 34 and the interior of the middle section 54, forms a chamber 60 for housing the spring 40. As an example, the chamber 60 may be filled with a gas, such as Nitrogen (for example), that aids in pressurizing the chamber 60 and thus, contributing to the force that is exerted against the operator mandrel 34. In other embodiments, other balancing techniques may be used. For example, the chamber 60 may include the spring 40 and not contain a pressurized gas. Alternatively, the chamber 60 may contain a pressurized gas and not include the spring 40. As another example, in some embodiments, annulus pressure may be used in the balancing, and as yet another example, two pressure conveying control lines may be extended from the surface of the well for purposes of controlling the operator mandrel 34. Other pressure balancing arrangements are possible that may be used with the lubricator 20 or with the lubricators described below.

Another mandrel 55 of the housing 42 is coupled between the middle section 54 and a generally cylindrical lower section 56 of the housing 42. The mandrel 55, in combination with the exterior of the operator mandrel 34 and the interior of the middle section 54, forms a chamber 44 for receiving the annulus fluid that contacts the lower surface 48 of the piston head 46. The radial port 38 may be formed in the middle section 54. The lubricator 20 may also include O-rings to establish seals for the chambers 44 and 50 and to generally seal off the annulus 21 from the central passageway 27 of the lubricator 70.

Figure 3:
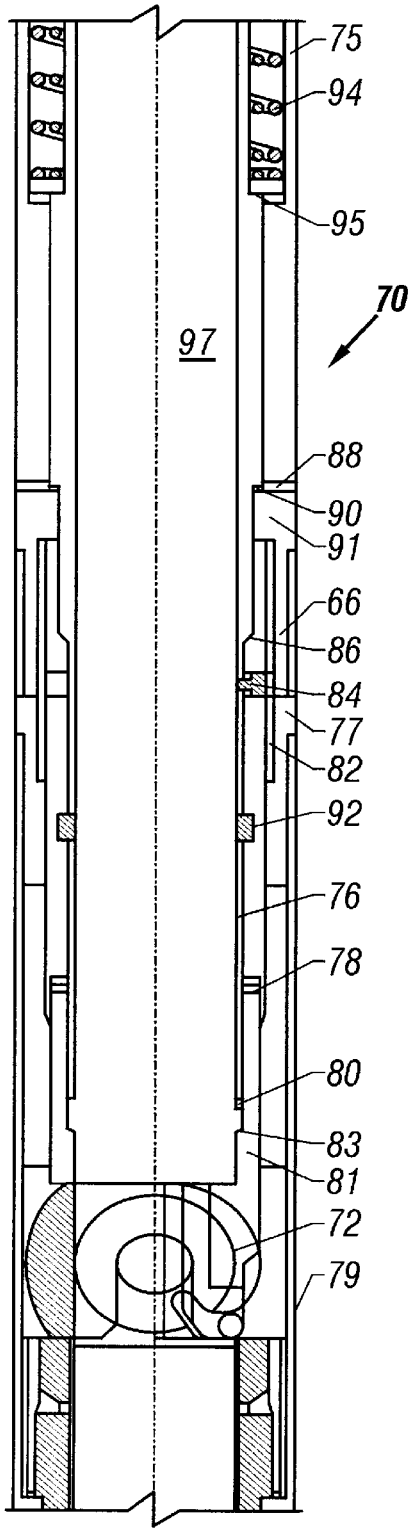
FIGS. 3 and 4 are cross-sectional views of a lubricator according to an embodiment of the invention.
Figure 4:
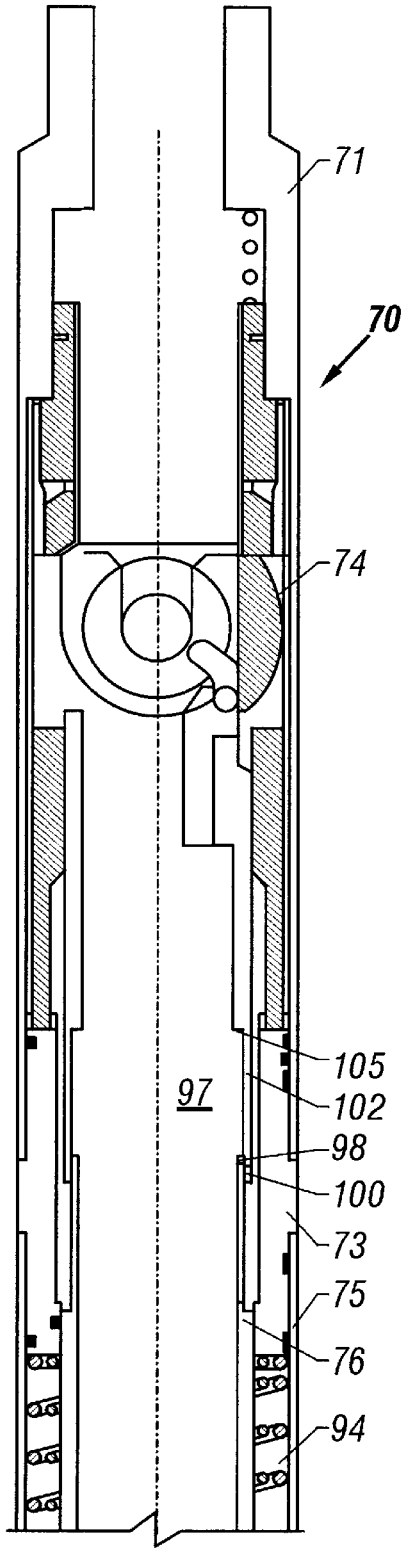

For the lubricator 20, continuous annulus pressure must be applied to keep the ball valves 30 and 32 opened or closed, depending on the particular embodiment. Referring to FIGS. 3 and 4, in another embodiment, a lubricator 70 may be used in place of the lubricator 20. Unlike the lubricator 20, the lubricator 70 has a hold close mechanism that keeps the ball valves 30 and 32 closed (for example) after pressure in the annulus 21 (see FIG. 1) is bled off, or released. More particularly, in some embodiments, the lubricator 70 includes an index mandrel 76 that tends to travel in an upward direction in response to pressure in the annulus 21. In this manner, referring to FIG. 3, when the index mandrel 76 travels a sufficient distance uphole, a lower radial extension 80 of the index mandrel 76 catches a lug 78 of a lower operator mandrel 81 and causes the operator mandrel 81 to travel in an upward direction and close a lower ball valve 72. Similarly, referring to FIG. 4, when the index mandrel 76 has traveled a sufficient distance uphole, an upper radial extension 98 of the index mandrel 76 pushes against a shoulder 105 of an upper operator mandrel 102 to cause the operator mandrel 102 to travel in an upward direction and close an upper ball valve 74. A spring 94 exerts a downward force on a shoulder 95 of the index mandrel 76, a force that may tend to keep the ball valves 72 and 74 open in the absence of sufficient annulus pressure if not for the hold close mechanism that is described below.

The hold close mechanism operates in the following manner to keep the ball valves 72 and 74 closed, even if pressure is bled off of the annulus 21. When the index mandrel 76 travels in an upward direction to close the ball valves 72 and 74, outward radial extensions 92 (one being shown in FIG. 3) of the index mandrel 76 slides past an index sleeve 82 that circumscribes the index mandrel 76. However, the upward travel of the index mandrel 76 causes the index sleeve 82 to rotate and prevent the extensions 92 from passing through the sleeve 82 on the mandrel's downward path. Therefore, if the applied annulus pressure is released, the index sleeve 82 prevents the index mandrel 76 from traveling further downhole, an action that would otherwise open the ball valves 72 and 74. To open the ball valves, surface pressure must be reapplied to the annulus 21 to cause the index mandrel 76 to travel uphole, an action that cause the index sleeve 82 to rotate to a position that allows the extensions 92 to pass through when pressure is subsequently bled off the annulus 21. In this manner, when pressure is removed from the annulus 21, the index sleeve 82 permits the index mandrel 76 to travel downhole to open the ball valves 72 and 74. In some embodiments, the above-described open and close cycle is repeatable. Thus, to summarize, in some embodiments, pressure is applied to the annulus 21 to close the ball valves 72 and 74. To open the ball valves 72 and 74, the pressure must be released, then reapplied and then released.

Figure 5:
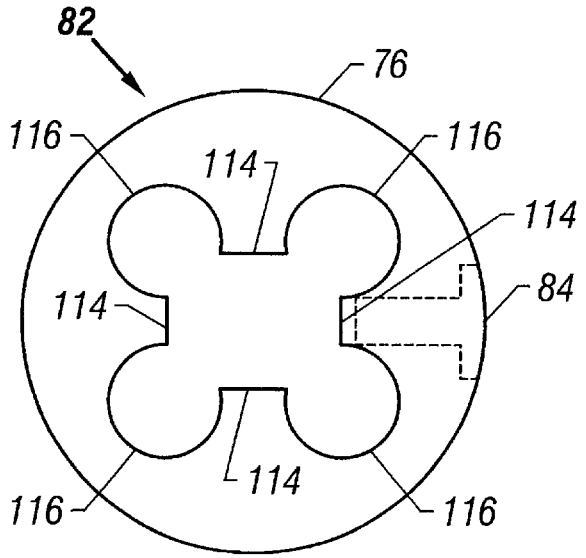
FIG. 5 is a cross-sectional view of the lubricator of FIGS. 3 and 4 taken along line 5—5 of FIG. 3.
Figure 6:
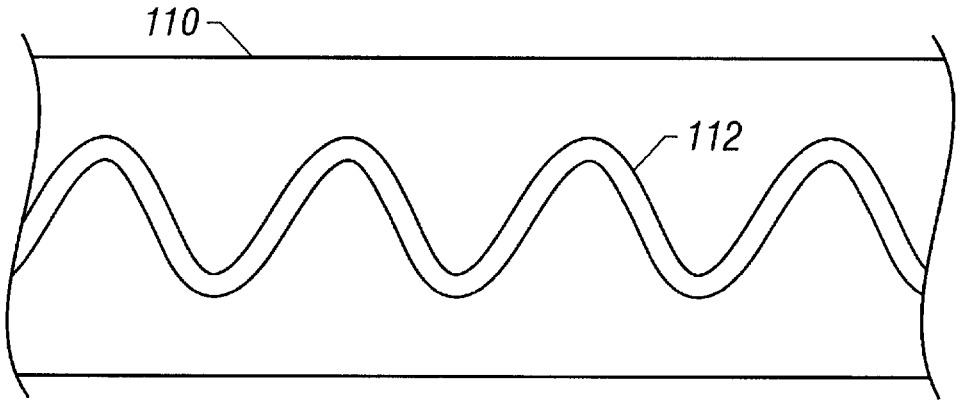
FIG. 6 is a schematic diagram of a J-slot of the lubricator of FIGS. 3 and 4.

Referring to FIG. 5, in some embodiments, the index sleeve 82 includes splines 114 that, when aligned with the extensions 92, halt the downward travel of the index mandrel 76. The index sleeve 82 also includes channels 116 that, when aligned with the extensions 92, allow the extensions 92 to pass through. Each time the index mandrel 76 travels uphole, the index sleeve 82 rotates by a predetermined angle (30°, 60° or 90° (as depicted in FIG. 5), as examples) to align the extensions 92 with either the channels 116 or the splines 114. In some embodiments, the rotation of the index sleeve 82 is accomplished via an index pin 84 and J-slot 112 (see FIG. 6) arrangement. In this manner, referring to FIG. 6, a portion 110 of the index mandrel 76 may include the slot 112 that serves as a guide for the index pin 84 that is partially disposed therein. The index pin 84 may be partially seated in one of the splines 114. Because the index mandrel 76 is confined not to rotate, the travel of the index pin 84 through the slot 112 causes the index sleeve 82 to rotate, as described above.

Figures 7, 8, 9, 10, 11:
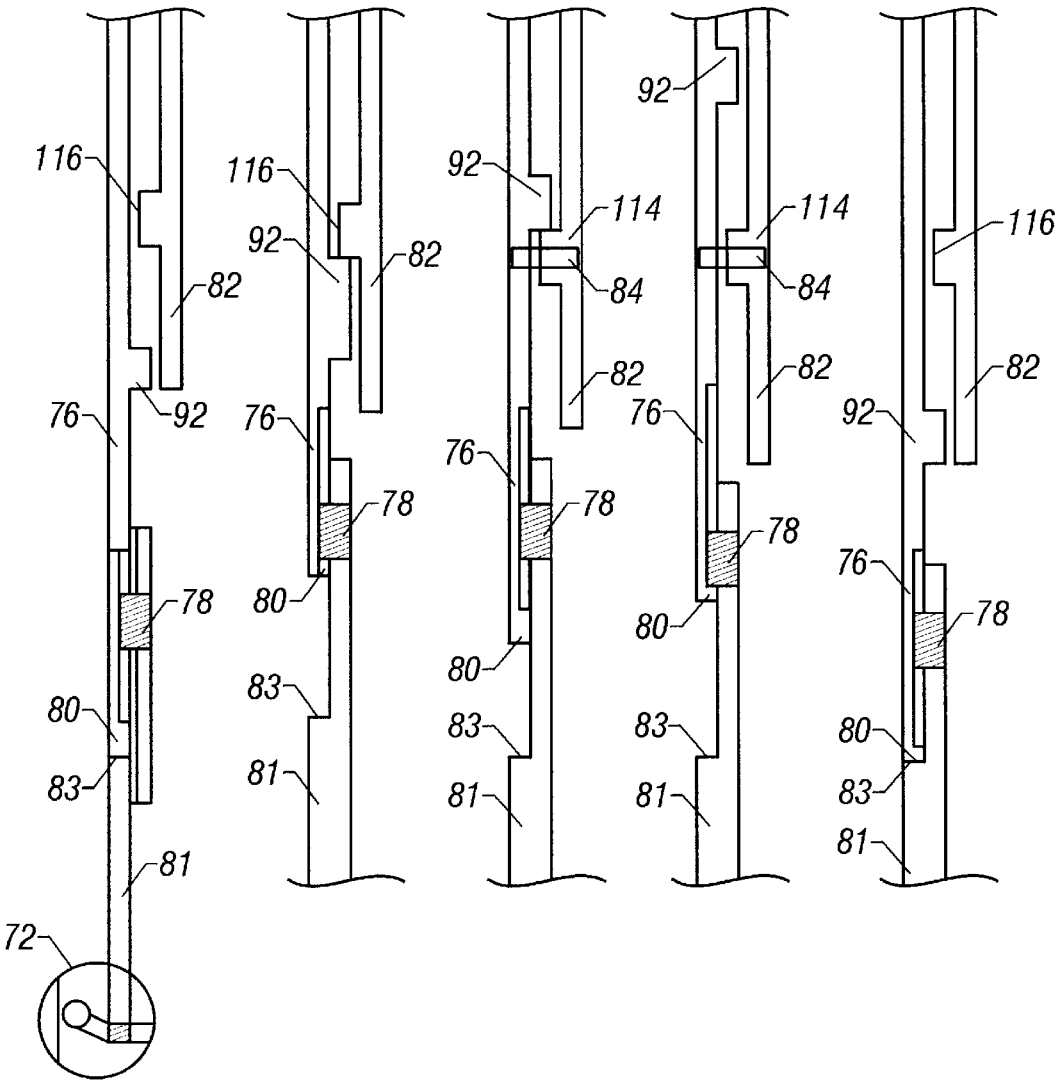
FIGS. 7, 8, 9, 10, 11, 12, 13, 14, 15 and 16 are schematic diagrams illustrating different operational states of the lubricator of FIGS. 3 and 4.

FIGS. 7, 8, 9, 10 and 11 illustrate operation of the lower ball valve 72. One half of the lubricator 72 is shown in each of these figures. FIG. 7 depicts the scenario where the lower ball valve 72 is opened. For this to occur, the index sleeve 82 is rotated to a position where the extensions 92 of the index mandrel 76 pass through the channels 116 of the index sleeve 82. As shown, the lower extension 80 of the index mandrel 76 contacts a shoulder 83 of the lower operator mandrel 81 to cause the operator mandrel 81 to open the lower ball valve 72.

FIG. 8 depicts a scenario when the lower ball valve 72 is closed. In this manner, for this scenario, the lower extension 80 of the index mandrel 76 catches the lug 78 and pulls the operator mandrel 81 in an upward direction to close the ball valve 72. As depicted in FIG. 8, the extensions 92 pass through the channels 116 of the index sleeve 82. However, the upward travel of the index mandrel 76 causes the index sleeve 82 to rotate by a predetermined angle (30°, 60° or 90°, as examples), and as a result, the extensions 92 are aligned with the splines 114, as depicted in FIG. 9. Thus, downward travel of the index mandrel 76 (and opening of the lower ball valve 74) is prevented, even if the applied annulus pressure is released.

At this point, to open the lower ball valve 72, pressure is bled off the annulus 21 and then reapplied to cause the index mandrel 82 to move in an upward direction, as depicted in FIG. 10. The upward travel of the index mandrel 76 causes the index sleeve 82 to rotate by a predetermined angle (30°, 60° or 90°, as examples) to a position where the extensions 92 of the index mandrel 76 may pass through the channels 116 of the index sleeve 82 and thus, permit the lower ball valve 72 to open, as depicted in FIG. 11.

Figures 12, 13, 14, 15, 16:
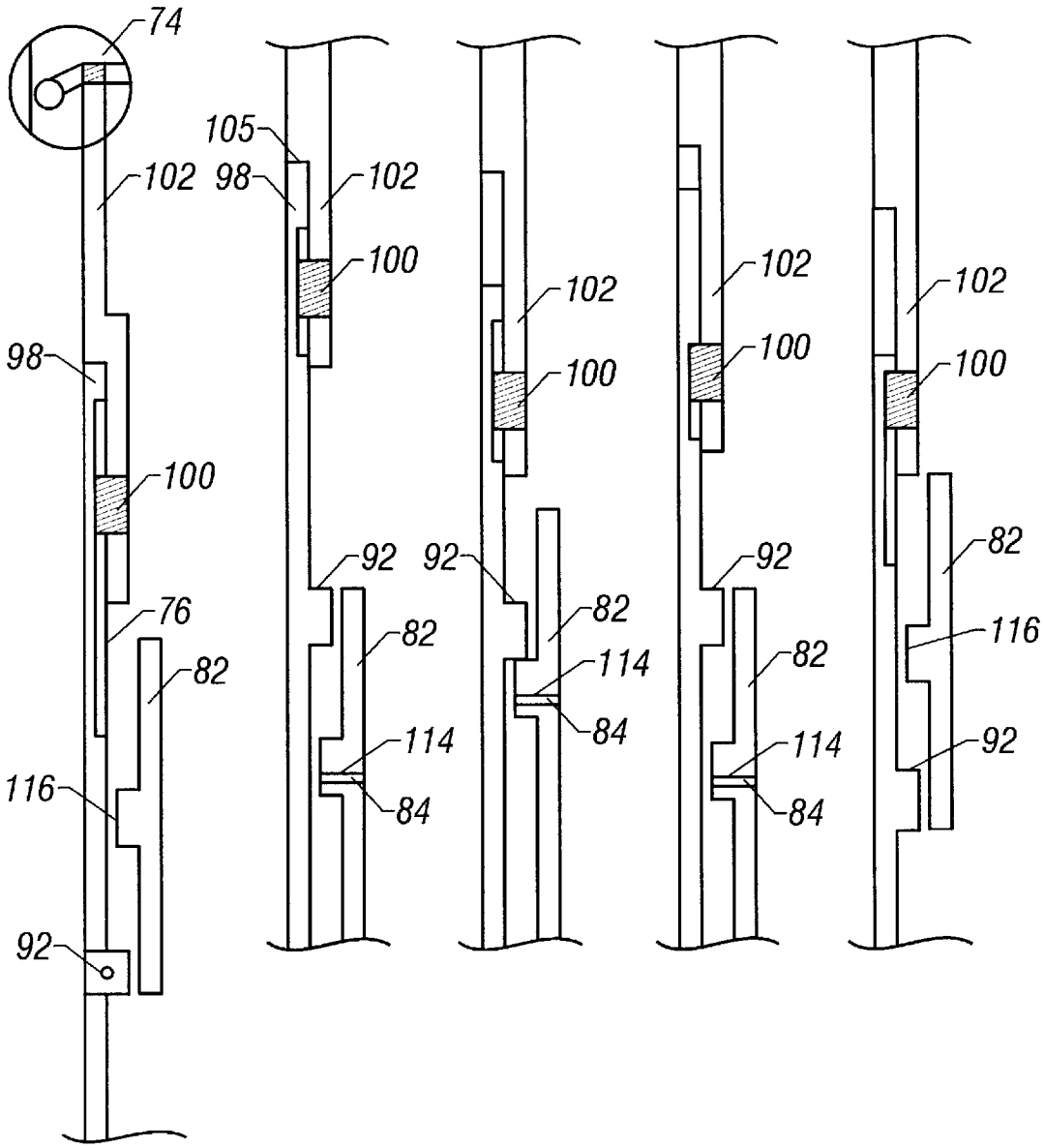

The upper ball valve 74 opens and closes with the lower ball valve 72. FIGS. 12, 13, 14, 15 and 16 illustrate operation of the upper ball valve 74. One half of the lubricator 72 is shown in each of these figures. FIG. 12 depicts the scenario where the upper ball valve 74 is opened. As shown, the upper extension 98 of the index mandrel 76 grabs a lug 100 of the upper operator mandrel 102 to cause the operator mandrel 102 to open the upper ball valve 74.

FIG. 13 depicts a scenario when the upper ball valve 74 is closed. In this manner, for this scenario, the upper extension 98 of the index mandrel 76 contacts a shoulder 105 of the upper operator mandrel 102 and pushes the operator mandrel 102 in an upward direction to close the ball valve 74. To reopen the ball valve 74, the above-described procedure is initiated to release the hold close mechanism that is depicted in FIG. 14. In this manner, to open the upper ball valve 74, pressure is bled off the annulus 21 and then reapplied to cause the index mandrel 76 to move in an upward direction, as depicted in FIG. 15. The upward travel of the index mandrel 82 causes the index sleeve 82 to rotate by a predetermined angle (30°, 60° or 90°, as examples) to a position where the extensions 92 of the index mandrel 76 may pass through the channels 114 of the index sleeve 82 and thus, permit the upper ball valve 74 to open, as depicted in FIG. 16.

Referring back to FIGS. 3 and 4, among the other features of the lubricator 70, the lubricator 70 may include an outer housing that is formed from generally cylindrical housing sections 79, 77, 75, 73 and 71 that are threadly connected (for example) together. The housing section 75 may form a chamber for the spring 94 and a chamber 91 that communicates with a radial port 88 that is formed in the section. The radial port 88 establishes fluid communication between the annulus 21 and the chamber 91 that, in turn, places a shoulder 90 of the index mandrel 76 in contact with the annulus fluid. The lubricator 70 may also include O-rings and other seals to establish seals for the chamber 91 and generally seal off the annulus 21 from a central passageway 97 of the lubricator 70.

Figure 17:
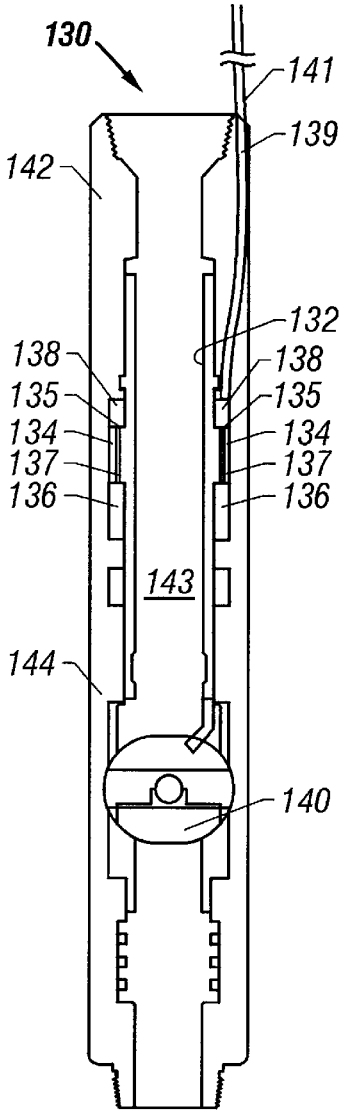
FIGS. 17 and 18 are cross-sectional views of a lubricator according to an embodiment of the invention.
Figure 18:
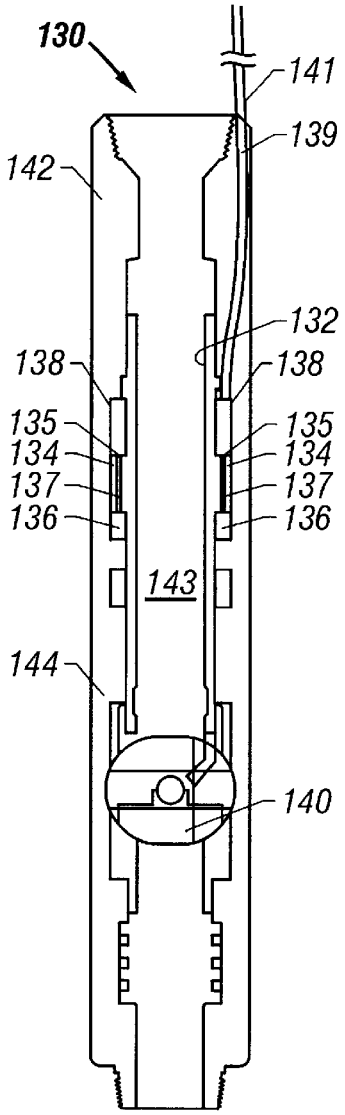

Referring to FIGS. 17 and 18, in some embodiments, a lubricator 130 may be used in place of the lubricator 20 or 70. The lubricator 130 is depicted as including a single ball valve 140 that may be operated to selectively seal off its central passageway 143. However, in some embodiments, the lubricator 130 may include another ball valve, similar to the arrangements described above. Alternatively, two lubricators that have single ball valves may be stacked together in some embodiments.

In some embodiments, the lubricator 130 may include an operator mandrel 132 that is connected to open and close the ball valve 140. The operator mandrel 132 includes an annular piston head 134 that piston head 134 resides in an annular region of an outer housing section 142 and forms an upper chamber 138 above the piston head 134 and a lower chamber 136 below the piston head 134. Via a passageway 139 in the housing section 142, the chamber 138 is in communication with a tubular line 141 that extends to the surface of the well 5. In this manner, the line 141 may be rapidly pressurized with a gas (Nitrogen, for example) to exert pressure on an upper surface 135 of the piston head 134. The piston head 134 includes a metered communication path between the upper 138 and lower 136 chambers. However, because the flow rate of the gas through this metered path is limited, rapid pressurization of the gas in the upper chamber 138 exerts a net downward force on the piston head 134, a force that moves the operator mandrel 132 downhole and opens the ball valve 140 (see FIG. 18).

Closing the ball valve 140 involves a procedure that creates the opposite pressure imbalance between the two chambers 136 and 138 than that described above in conjunction with opening the ball valve 140. In this manner, eventually after the ball valve 140 is opened, the pressures in the upper 138 and lower 136 chambers equalize due to the metered passageway that is provided by the piston head 134. To close the ball valve 140, the line 141 may be used to rapidly bleed off gas from the chamber 138, an event that forces the operator mandrel 132 in an upward direction due to open the inability of the metered passageway to instantaneously equalize the pressures in the two chambers 136 and 138.

Among the other features of the lubricator 130, the lubricator 130 may include another cylindrical housing section 144 that is threadably coupled to the upper section 142. The lubricator 130 may also include also include O-rings and other seals to establish seals for the chambers 136 and 138 and to generally seal off the annulus 21 from the central passageway 141 of the lubricator 130.

Figure 19:
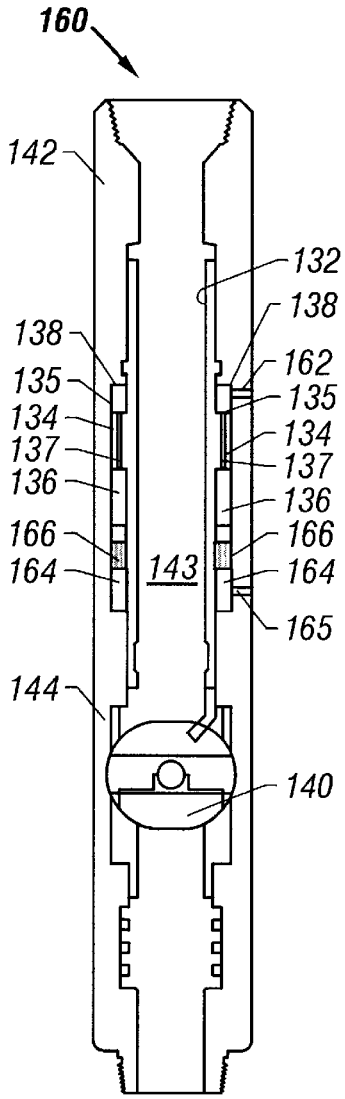
FIG. 19 is a cross-sectional view of a lubricator according to an embodiment of the invention.

In some embodiments, the above-described lubricators may be replaced by a lubricator 160 that is depicted in FIG. 19. The lubricator 160 is similar to the lubricator 130 except for the features noted below. In particular, in the lubricator 160, the line 141 is replaced with a radial port 162 that establishes communication between the annulus 21 and a chamber 164 of the lubricator 160. Thus, pressure at the surface of the well may be applied to the annulus 21 for purposes of opening and closing the ball valve 140. In this manner, the chamber 164 is formed in part by the annular region that establishes the chambers 136 and 138. A radial port 165 establishes fluid communication between the annulus 21 and the chamber 164. An unattached annular piston 166 separates the chambers 164 and 136, and chambers 136 and 138 contain a gas, such as Nitrogen. Therefore, when pressure is rapidly applied to the annulus 21, the fluid from the annulus 21 forces the piston 166 upwards. The upward travel of the piston 166, in turn, forces the operator mandrel 132 in an upward direction, as the metering passageway in the piston head 134 does not communicate the gas between the chambers 136 and 138 in a rapid enough manner to prevent the pressure imbalance. The upward travel of the operator mandrel 132, in turn, closes the ball valve 140.

The ball valve 140 may be opened by rapidly bleeding pressure from the annulus 21 to cause a pressure imbalance between the chambers 136 and 138 to force the operator mandrel 132 in a downward direction.

Figure 20:
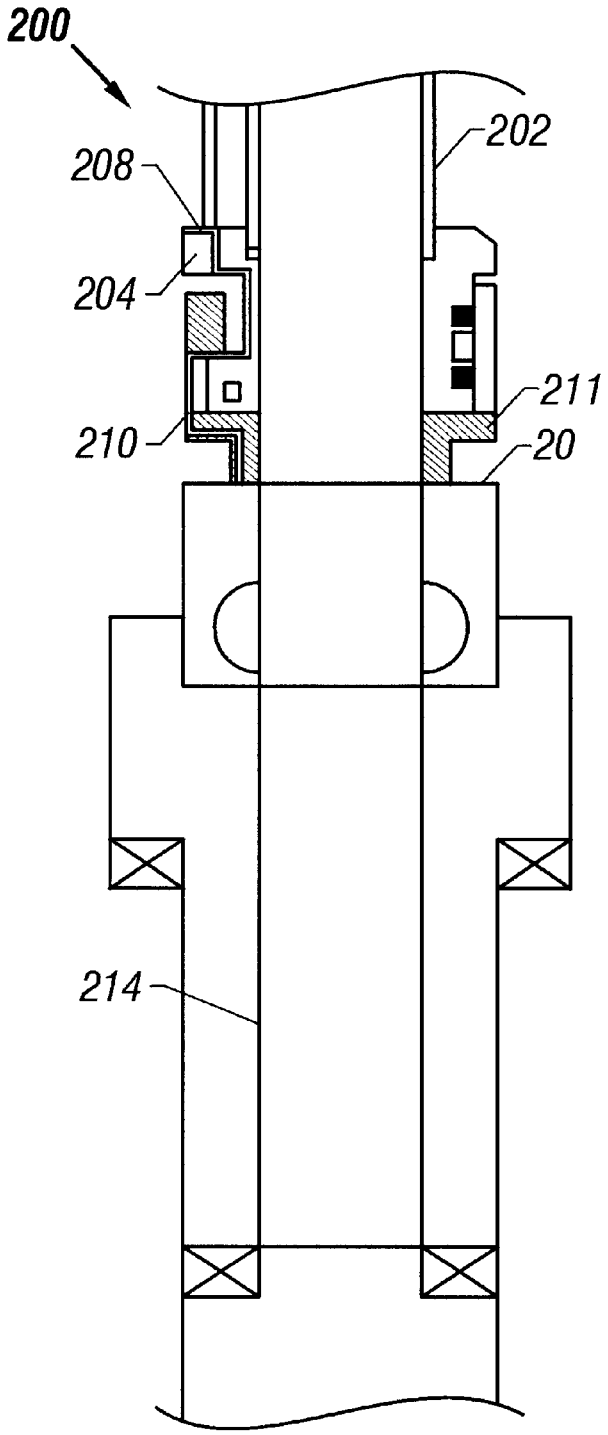
FIGS. 20 and 21 are schematic diagrams of wells according to different embodiments of the invention.

Referring back to FIG. 1, in the well 5 described above, the lubricator 20 is permanently connected to the tubing 16. Due to this arrangement, the entire tubing 16 must be removed before other operations, such as measurements, are performed. Referring to FIG. 20, in another well 200, a tubing 202 (that replaces the tubing 16) may have a stabbing connector assembly 204 connected to its downhole end. In this manner, the assembly 204 may be used to stab a seal assembly into a polished bore receptacle (PBR) 211 that is coupled to the lubricator 130 (for example) that, in turn, is further coupled to additional tubing 214 that extends downhole. The assembly 204 may include a passageway 208 that establishes fluid communication between the line 141, a passageway 210 of the PBR 211 and the lubricator 20. Thus, due to this arrangement, the tubing 202 may be removed while the lubricator 20 and the tubing 214 are left downhole.

Figure 21:
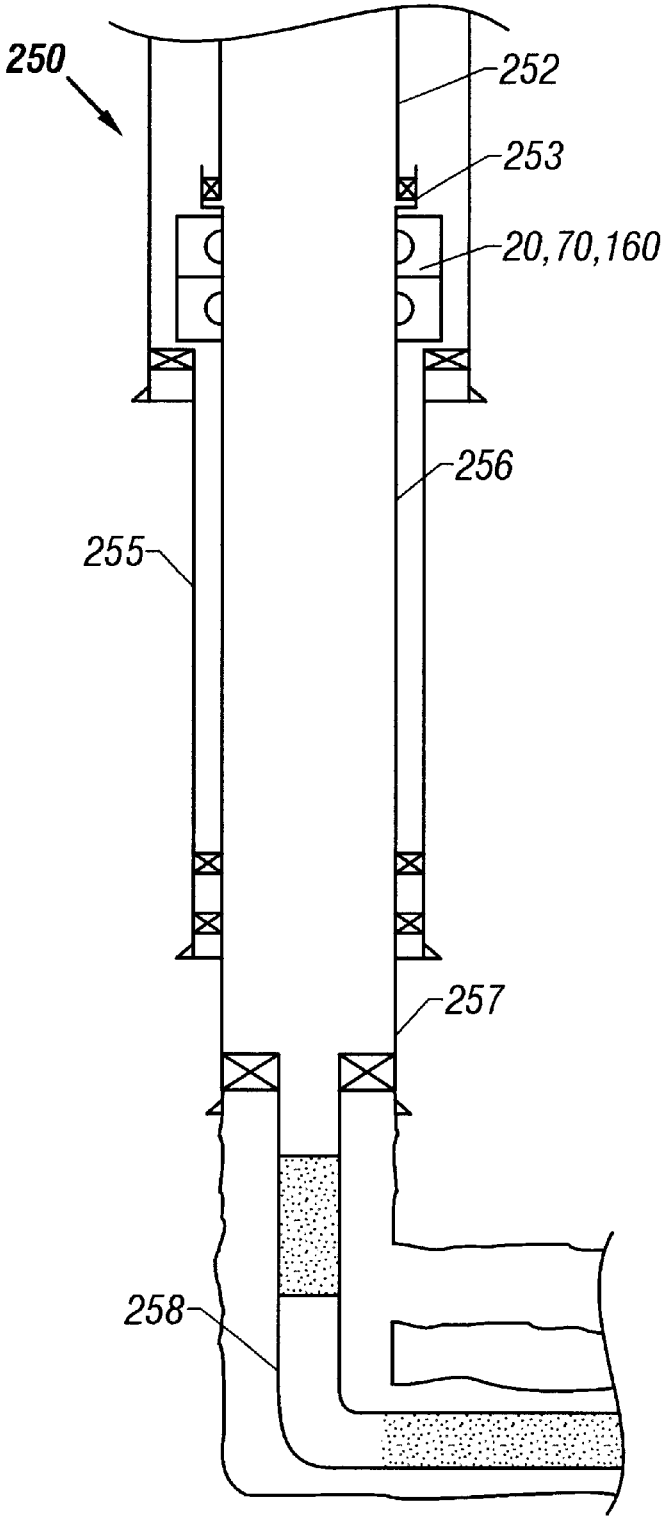

Referring to FIG. 21, in another well 250, a lubricator (such as the lubricators 20, 70 and 160, as examples) that is controlled by annulus pressure may be arranged in the following manner. The lubricator may be permanently coupled and concentrically aligned with tubing 256 that extends downhole of the lubricator. The annular space between the tubing 256 and a casing 255 that surrounds the tubing 256 is sealed to form an annulus for communicating with the lubricator. A liner 257 may also be sealed and secured to the inside of the well casing 255 and reside below the tubing 256. A production pipe 258 may be located below the liner 257 and connected to provide production fluid to the central passageway of the tubing 256. Above the lubricator, an upper tubing 252 may extend to the surface of the well 250. The upper tubing 252 rests and is sealed to a flange 253 that is formed in the upper end of the tubing 254. Due to this arrangement, the upper tubing 252 may be removed from the well 250, and the lubricator and tubing 256 remain downhole.

Figure 22:
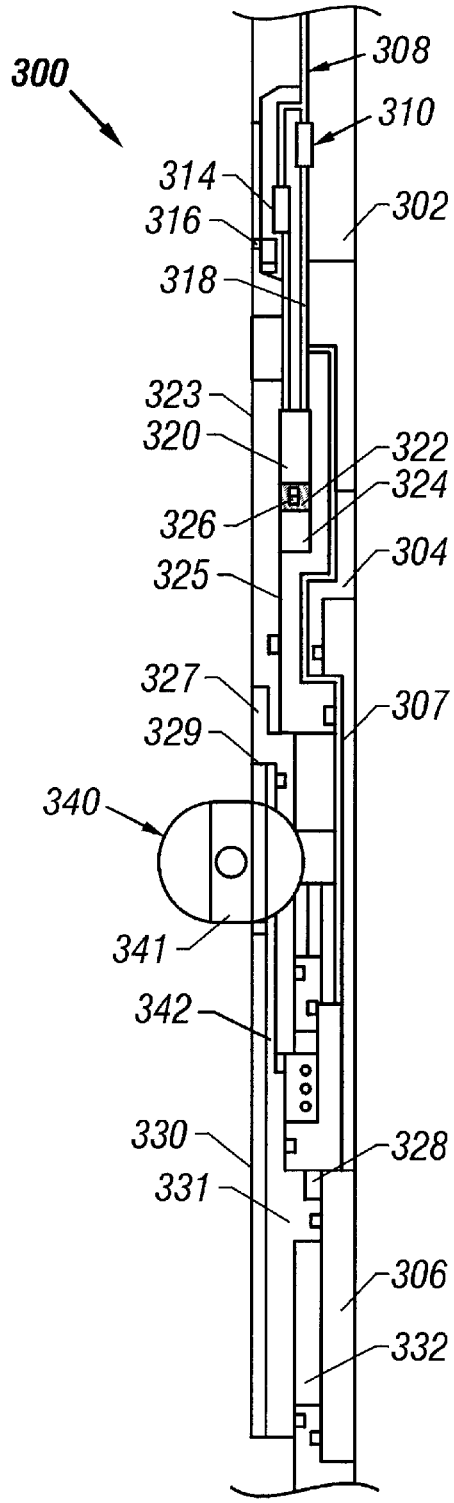
FIG. 22 is a cross-sectional view of a lubricator according to an embodiment of the invention.

Referring to FIG. 22, in some embodiments of the invention, a lubricator 300 may be used in place of the lubricators that are depicted above. Unlike these other lubricators, the lubricator 300 includes a protective sleeve 342 to protect a ball valve 340 of the lubricator 300 from drilling related debris, such as drilling fluid and cuttings, for example. In this manner, as described below, after the lubricator 300 opens the ball valve 340, the lubricator 300 moves the sleeve 342 into an up position in which the sleeve is located in the central passageway 341 of the ball valve 340; and before the lubricator 300 closes the ball valve 340, the lubricator 300 moves the sleeve 342 to a down position, a position that permits the ball valve 340 to rotate and close.

More specifically, in some embodiments of the invention, the lubricator 300 operates the ball valve 340 and sleeve 342 in response to the pressure that is applied via a control line that extends from a surface of the well to an internal passageway 308 of the lubricator 300. In some embodiments of the invention, the control line may be filled with nitrogen gas that is pressurized and de-pressurized, as described below, to control operation of the ball valve 340 and sleeve 342.

For purposes of operating the ball valve 340, the lubricator 300 includes an operator mandrel 325 includes a generally cylindrical portion 323 that is aligned with the longitudinal axis of the lubricator 300 and is connected (via another cylindrical portion 327 that is aligned with the longitudinal axis of the lubricator 300) to the ball valve 340. Due to this arrangement, when the operator mandrel 325 moves in an upward direction, the ball valve 340 closes to block fluid flow through the central passageway of the lubricator 300. When the operator mandrel 325 moves in a downward direction, the ball valve 340 opens to align its central passageway with the central passageway of the lubricator 300 to permit fluid communication through the ball valve 340.

For purposes of moving the operator mandrel 325, the operator mandrel 325 includes an annular piston head 322 that extends in a radially outward direction from the cylindrical portion 323. The piston head 322 is located in an annular cavity that is formed between the cylindrical portion 323 and a generally cylindrical outer housing section 304 that circumscribes the cylindrical portion 323. The annular cavity forms an upper cylinder 320 above the piston head 322 and a lower cylinder 324 (shown having no volume in FIG. 22) below the piston head 322. Thus, as depicted in FIG. 22, the volumes of the upper 320 and lower 324 chambers change with the movement of the piston head 322.

Movement of the piston head 322 (and thus, movement of the operator mandrel 325 and ball valve 340) may be induced by changing the pressure level in the control line that communicates with the passageway 308, as the control line is in communication with the passageway 308 for certain pressure levels (as described below) via an internal passageway 318. The piston head 322 includes a metering passageway 326 to establish communication between the upper 320 and lower 324 chambers. Although the metering passageway 326 permits pressure equalization between the upper 320 and lower 324 chambers over time, the metering passageway 326 restricts the rate at which pressure equalization occurs, allowing sudden changes to the pressure in the upper chamber 320 to control movement of the operator mandrel 325 and thus, control operation of the ball valve 340, as described below.

To manipulate the pressure that is applied to the upper chamber 320 for purposes of operating the ball valve 340 and sleeve 342 (as described further below), the lubricator 300 includes a relief valve 314 that is located between the passageway 308 and the chamber 320. The relief valve 314 opens to permit communicate of fluid between the passageway 308 and the chamber 320 when the pressure in the passageway 308 exceeds a predetermined threshold, such as 1500 pounds per square inch (psi), for example. In some embodiments of the invention, the threshold for the relief valve 314 is set slightly higher than the fluid hydrostatic pressure in the annulus. This assures that the ball valve 340 remains in its current position in case of control line failure at any depth. The lubricator valve 300 also includes a check valve 316 that is located between the passageway 308 and the chamber 320 and is in a parallel arrangement with the relief valve 314. The check valve 316 provides a path to communicate fluid away from the upper chamber 320 to bleed off pressure from the upper chamber 320 to control movement of the operator mandrel 325, as described below.

The following describes a technique to close the ball valve 340 when the ball valve 340 is currently open. First, a determination is made whether the control line is pressurized. If so, then pressure in the control line is bled off through a fast bleed port in a manifold at the surface of the well so that the upper chamber 320 has near zero pressure. At this point, due to the restriction that is introduced by the metering passageway 326, the lower chamber 324 retains approximately the same pressure that existed before de-pressurization of the control line. Thus, by rapidly de-pressurizing the control line, a differential pressure is created across the piston 322 to cause the operator mandrel 325 to move in an upward direction and close the ball valve 340.

If the ball valve 340 is open and the control line is not pressurized, then the control line must first be pressurized to a pressure that is to slightly higher than the threshold of the relief valve 314. The increased pressure is maintained, or held, for a holding period, such as 5 to 10 minutes, for example. The holding period allows sufficient time from the pressures in the two chambers 320 and 324 to equalize. After this holding period, the control line is rapidly de-pressurized to create the differential pressure across the piston 322 to cause the operator mandrel 325 to move in an upward direction and close the ball valve 340, as described above.

The following technique may be used to open the ball valve 340 when the ball valve 340 is currently closed. First, the pressure in the tubing above the ball valve 340 is adjusted to ensure that the pressure differential across the ball valve 340 is less than 1000 psi. If possible, the pressure across the ball valve 340 is equalized. Next, the pressure in the control line is rapidly increased to a pressure that is slightly higher than the relief valve threshold pressure. For example, this increase may occur within an interval of one to two minutes, in some embodiments of the invention. In response to this increase, a pressure differential is created across the piston 322 causing the operator mandrel 325 to move and open the ball valve 340. The pressure in the control line is then slowly bled off through a slow bleed port in the surface manifold, for example. Because the upper chamber 320 is slowly de-pressurized, the metering passageway 326 keeps the pressure differential between the upper 320 and lower 324 chambers near zero. This by itself keeps the ball valve 340 open. However, in some embodiments of the invention, at this point, the sleeve 342 is positioned inside the central passageway 341 of the ball valve 340 to lock the ball valve 340 in place to keep the ball valve from closing, as described further below.

An advantage of using the above-described arrangement is that an operator may select the position to which the ball valve 340 defaults if the pressure integrity of the control line is lost at the surface or near the lubricator 300. For example, if the operator wishes to keep the ball valve 340 closed even if the control line loose pressure integrity, then the operator maintains the control line pressure to keep the control line pressure within the difference (500 psi, for example) of the relief valve threshold and the pressure in the annulus. This keeps the ball valve 340 closed regardless where the control line fails. If the operator wishes to keep the ball valve 340 open regardless if the control line looses pressure integrity at the surface or at the lubricator valve 300, then the operator should bleed off the control line pressure so that no matter where the control line breaks, the ball valve 340 remains open.

In some embodiments of the invention, the sleeve 342 is part of an operator mandrel 330 that, in addition to the generally cylindrical section that forms the sleeve 342, includes a piston 331 that extends in a radially outward direction into a cavity that is formed between the operator mandrel 330 and an outer housing section 306 of the lubricator 300. The piston 331 divides this cavity into a chamber 328 that is in communication with the passageway 318 and in contact with an upper face of the piston 331; and a sealed chamber 332 that is in contact with a lower face of the piston 331. In this manner, the sealed chamber 332 is filled with a gas (nitrogen or air at atmospheric pressure, for example) that exerts an upward force against the lower surface of the piston 331. Alternatively, the chamber 332 may include a spring to exert a force against the lower surface of the piston 331. The upper face of the piston 331 receives a force that is applied by the gas that is present in the chamber 328. Due to this arrangement, pressure may be applied to the gas in the control line to move the sleeve 342 to its down position out of the ball valve 340, and pressure may be bled out of the control line to move the sleeve 342 to its up position inside the ball valve 340.

More particularly, in some embodiments of the invention, the lubricator 300 includes a gas metering device 310 (a gas metering passageway, for example) that is located between the passageway 308 and an internal passageway 307 that extends to the chamber 328. As described below, the gas metering device 310 establishes a delay to permit the ball valve 340 to open before the sleeve 342 is inserted into the central passageway 341 of the ball valve 340 and a delay in the removal of the sleeve 342 from the passageway 341 to prevent the ball valve 340 from prematurely closing, as described below.

Figure 23:
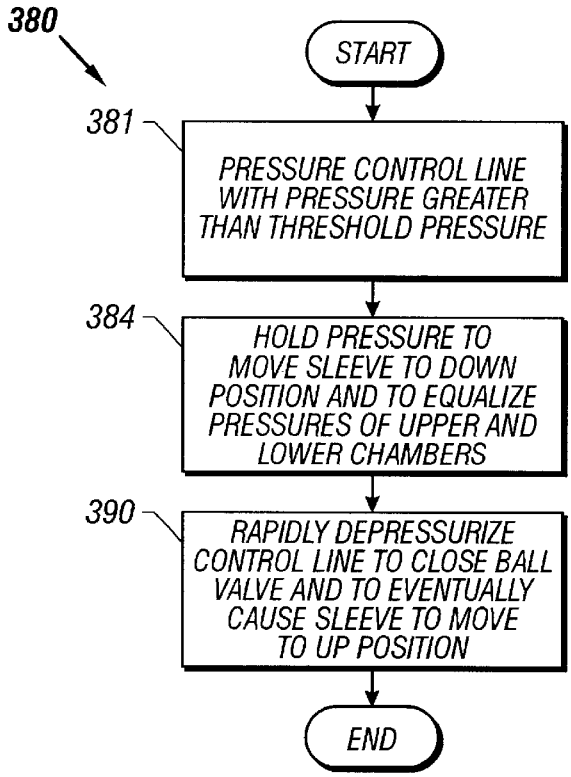
FIG. 23 is a flow diagram depicting an algorithm to close a ball valve of the lubricator according to an embodiment of the invention.

FIG. 23 depicts a flow diagram that illustrates a control technique 380 to close the ball valve 340 and operate the sleeve 342 accordingly. For this example, it is assumed that the threshold pressure of the relief valve is approximately 1500 psi, and the sealed chamber 328 is precharged with 500 psi of gas, such as nitrogen gas, for example. In the technique 380, the control line is pressurized (block 381) with a pressure (2000 psi, for example) that is greater than the threshold pressure (1500 psi, for example) of the relief valve 314. This pressure is then held (block 384) for a few minutes to move the sleeve 342 to its down position and set the pressure differential between the upper 320 and lower 324 chambers to near zero. In this manner, during this period, the gas meters through the cover sleeve gas metering device 310 and fills the chamber 328 to pull the sleeve 342 out of the ball valve 340. Also, during this period, the gas fills the upper chamber 320 and then fills the lower chamber 324 through the gas metering passageway 326. During this equalization, the operator mandrel 325 does not move down because the mandrel 325 is already in the down position. Thus, at this point, the ball valve 340 remains open.

Next, the control line is rapidly depressurized (block 390) by, for example, using a fast bleed port in the surface manifold. Due to this action, the operator mandrel 325 moves to close the ball valve 340, and the pressure in the chamber 328 slowly bleeds off due to the gas metering device 310. When pressure in the control line is bled off below the 500 psi level (i.e., the pressure exerted by the gas in the sealed chamber 332 for this example), the gas pressure in the chamber 332 forces the operator mandrel 325 in an upward direction to push the sleeve 342 against the ball valve 340. The ball valve 340 acts as a stop to limit upward travel of the sleeve 342. The pressure in the control line, the upper 320 and lower 324 chambers, and the chamber 328 then bleeds down to atmospheric pressure after some time.

Figure 24:
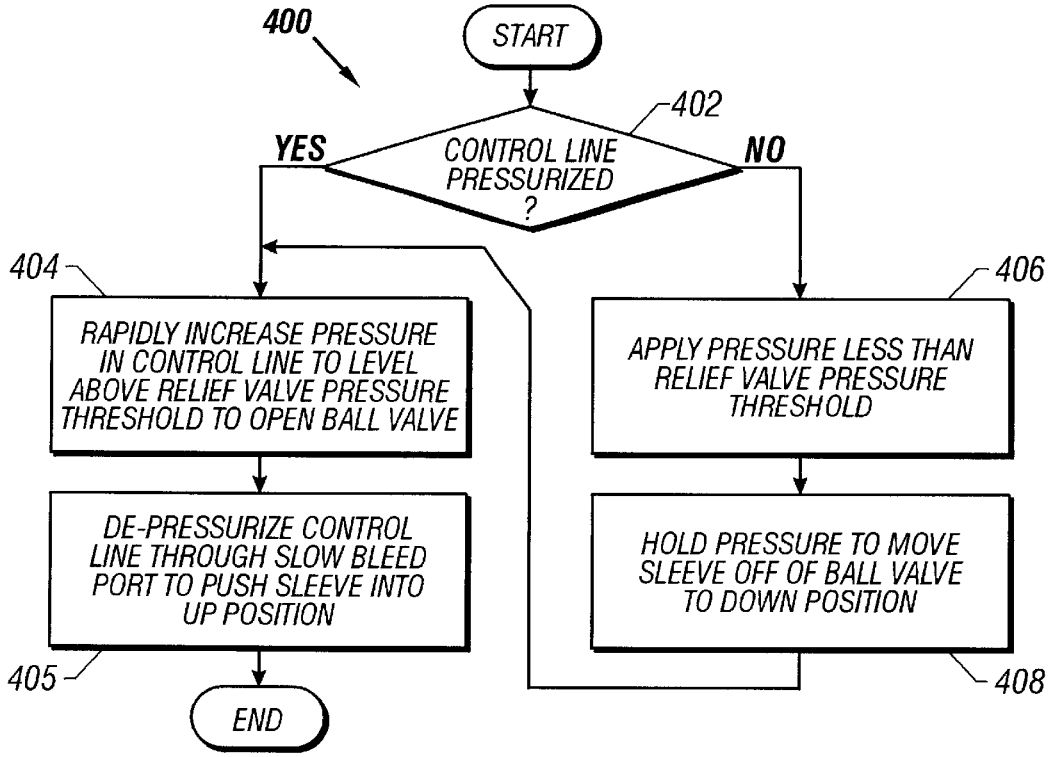
FIG. 24 is a flow diagram depicting an algorithm to open a ball valve of the lubricator according to an embodiment of the invention.

FIG. 24 depicts a flow diagram that illustrates a control technique 400 to open the ball valve 340 and operate the sleeve 342 accordingly. In this technique, first a determination is made (diamond 402) whether the control line is pressurized. If not, pressure less than the relief valve pressure threshold is applied (block 406), such as 1000 psi (for example) and held (block 408). This action moves the sleeve 342 to its down position, as the gas meters through the gas metering device 310 to push the sleeve 342 off of the ball valve 340.

The ball valve 340 remains closed at this point. Next, regardless of whether the control line was initially pressurized or not, the pressure in the control line is rapidly increased (block 404), such as increased to 2000 psi (a pressure above the relief valve pressure of 1500 psi, as an example), to induce a pressure imbalance between the upper 320 and lower 324 chambers to move the operator mandrel 325 to open the ball valve 340. After some time, the upper chamber 320, the lower chamber 324 and the chamber 328 all have the same pressure, such as a pressure near 2000 psi, for example. Next, the control line is de-pressurized (block 405) through the slow bleed port in the surface manifold, for example. This action keeps the ball valve 340 in the open position and permits the pressure inside the sealed chamber 332 to push the sleeve 342 into the central passageway 341 of the ball valve 340. In this manner, the sleeve 342 rests on a shoulder 327 that is formed on the operator mandrel 325 to limit the upward travel of the sleeve 342 when the ball valve 340 is open. The above-described opening and closing of the ball valve 340 may be repeated as many times as required.

Referring back to FIG. 22, among the other features of the lubricator 300, the lubricator 300 may be formed from upper 302, middle 304 and lower 306 generally cylindrical housing sections. The passageway 308 is formed in the upper housing section 302, and the upper housing section 302 also encloses the pressure relief valve 314, the gas metering device 310 and the one way check valve 316. The passageway 307 extends from the gas metering device 310 through the upper 302, middle 304 and lower 306 housing sections to the chamber 328.

Figure 25:
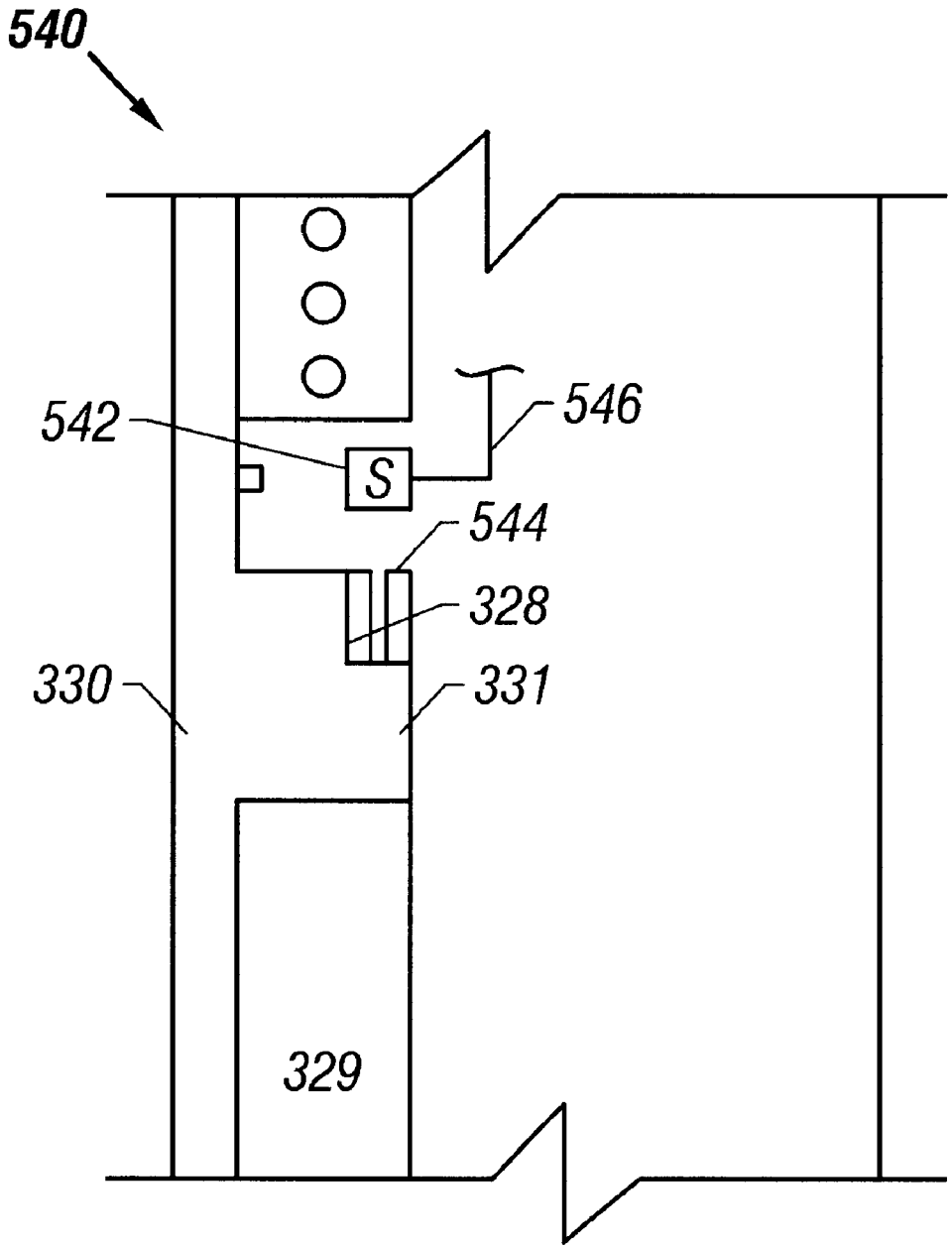
FIG. 25 is a cross-sectional view of a portion of a lubricator valve according to an embodiment of the invention.

Techniques other than pressure may be used to move the sleeve operator mandrel 330. For example, FIG. 25 depicts a portion 540 of a lubricator of similar design to the lubricators that are described above with the following exception. In this manner, the lubricator includes a solenoid 542 that has a shaft 544 that is connected to the operator mandrel 330. Due to this arrangement, the solenoid 542 may be controlled (via electrical lines 546) to move the sleeve 342 up and down as desired. As an example, the electrical lines 546 may be connected to electronics of the lubricator, and the electronics, may, for example control operation of the sleeve 342 in response to pressure pulses that are communicated downhole. Alternatively, the electrical lines 546 may extend from the surface of the well to directly control operation of the operator mandrel 330. Other arrangements are possible.

Other embodiments are within the scope of the following claims. For example, the lubricator may be constructed to be remotely controlled by arrangements other than those described above. In this manner, the lubricator may be constructed to respond to tubing conveyed pressure, electrical signals (via electrical wires) and coded pressure pulses, as just a few examples of other stimuli that may be communicated downhole. As examples of other embodiments, the lubricator may use valves other than ball valves. For example, the lubricator may include one or more flapper valves. As yet another example, the lubricator and any associated control line may be run downhole with the well casing. Therefore, the lubricator and control line may be cemented in place with the well casing. Thus, by using this technique, the inner diameter of the lubricator may be increased.

While the invention has been disclosed with respect to a limited number of embodiments, those skilled in the art, having the benefit of this disclosure, will appreciate numerous modifications and variations therefrom.

What is claimed is:

1. A system usable with a subterranean well, comprising:

a drill string;

a tubing adapted to receive the drill string in a passageway of the tubing; and a lubricator located downhole away from a surface of the well and connected to the tubing, the lubricator adapted to receive the drill string and be remotely operable from a surface of the well to control fluid communication between the passageway located above the lubricator and a formation located beneath the lubricator.

2. The system of claim 1, wherein the lubricator is located at least one thousand feet from the surface of the well.

3. The system of claim 1, wherein the lubricator is adapted to permit an operator to select whether the lubricator defaults to an open or a closed position.

4. The system of claim 1, wherein the lubricator comprises at least two ball valves coupled to operate in synchronization.

5. The system of claim 1, wherein the lubricator is further adapted to respond to pressure changes in an annulus that surrounds the lubricator.

6. The system of claim 5, wherein the lubricator is further adapted to respond to a predetermined sequence of pressure changes before isolating the passageway above the lubricator from the formation.

7. The system of claim 1, wherein the lubricator is adapted to respond to a pressure controllable from the surface to control the fluid communication between the passageway located above the lubricator and the formation located beneath the lubricator.

8. The system of claim 7, wherein the lubricator is adapted to close the communication in response to a decrease in the pressure.

9. The system of claim 7, wherein the lubricator is adapted to open the communication in response to a decrease in the pressure.

10. The system of claim 1, wherein the lubricator comprises:

a valve positioned to control the communication; and an operator mandrel connected to open and close the valve in response to a stimuli communicated from the surface of the well.

11. The system of claim 10, wherein the stimuli comprises a pressure change in another fluid.

12. The system of claim 11, wherein the operator is adapted to move to close the valve in response to the pressure in said another fluid decreasing.

13. The system of claim 11, wherein the operator is adapted to move to open the valve in response to the pressure in said another fluid decreasing.

14. The system of claim 10, wherein the lubricator further comprises:

a hold close mechanism to prevent unintentional opening of the valve.

15. The system of claim 1, wherein the lubricator comprises:

a valve adapted to open and close the communication.

16. The system of claim 15, wherein the valve comprises a ball valve.

17. The system of claim 15, wherein the valve includes a central passageway for communicating the fluid, the lubricator further comprising:

a sleeve adapted to selectively move inside the central passageway to protect the valve.

18. The system of claim 17, wherein the sleeve is adapted to move in the central passageway in response to the opening of the valve.

19. The system of claim 17, wherein the sleeve is adapted to move out of the central passageway in response to the opening of the valve.

20. The system of claim 17, wherein the lubricator further comprises:

an operator mandrel to move the sleeve in response to a pressure stimuli controllable form the surface of the well.

21. The system of claim 20, wherein the lubricator further comprises:

a gas metering device adapted to delay the response of the operator mandrel to prevent the sleeve from moving into the central passageway of the valve before the valve opens.

22. The system of claim 20, wherein the valve is adapted to respond to the pressure stimuli, the lubricator further comprising:

a pressure relief valve adapted to establish a first range of pressures for controlling the valve and a second range of pressures for controlling the sleeve.

23. A system usable with a subterranean well, comprising:

a tubing adapted to receive a string in a passageway of the tubing; and a lubricator located downhole away from a surface of the well and connected to the tubing, the lubricator adapted to receive the string and be remotely operable from a surface of the well to control fluid communication between the passageway located above the lubricator and a formation located beneath the lubricator, the lubricator comprising:

a valve having a central passageway for communicating the fluid and adapted to open and close the communication of the fluid; and a sleeve adapted to selectively move inside the central passageway to protect the valve.

24. The system of claim 23, wherein the sleeve is adapted to move in the central passageway in response to the opening of the valve.

25. The system of claim 23, wherein the sleeve is adapted to move out of the central passageway in response to the opening of the valve.

26. The system of claim 23, wherein the lubricator further comprises:

an operator mandrel to move the sleeve in response to a pressure stimuli controllable form the surface of the well.

27. The system of claim 26, wherein the lubricator further comprises:

a gas metering device adapted to delay the response of the operator mandrel to prevent the sleeve from moving into the central passageway of the valve before the valve opens.

28. The system of claim 26, wherein the valve is adapted to respond to the pressure stimuli, the lubricator further comprising:

a pressure relief valve adapted to establish a first range of pressures for controlling the valve and a second range of pressures for controlling the sleeve.

* * * * *